US005703924A

United States Patent [19]

Hell et al.

[11] Patent Number: 5,703,924

[45] Date of Patent: Dec. 30, 1997

[54] X-RAY TUBE WITH A LOW-TEMPERATURE EMITTER

[75] Inventors: Erich Hell, Erlangen; Helmut Kuhn, Weissenbrunn; Mathias Hoernig, Erlangen, all of Germany

[73] Assignee: Siemens Aktiengesellschaft, Munich, Germany

[21] Appl. No.: 627,999

[22] Filed: Apr. 4, 1996

[30] Foreign Application Priority Data

Apr. 7, 1995 [DE] Germany ..... 195 13 290.4

[51] Int. Cl.[6] ..... H01J 35/06

[52] U.S. Cl. ..... 378/136; 378/138

[58] Field of Search ..... 378/136, 138, 378/113

[56] References Cited

U.S. PATENT DOCUMENTS 4,060,731 11/1977 Pissi ..... 378/113
4,145,616 3/1979 Tanabe ..... 378/113
5,142,652 8/1992 Reichenberger ..... 378/134
5,170,422 12/1992 Fiebiger .

FOREIGN PATENT DOCUMENTS 42 30 047 10/1993 Germany .
WO92/0383 3/1992 WIPO .

*Primary Examiner*—Craig E. Church
*Attorney, Agent, or Firm*—Hill, Steadman & Simpson

[57] ABSTRACT

An x-ray tube has an anode and an electron emitter from which an electron beam emanates, the electron beam impinging the incident surface of the anode in a focal spot from which a useful x-ray beam emanates. At least in the region of its electron-emitting surface, the electron emitter is formed of an electron-emitting material that has a lower electron affinity than tungsten (a low-temperature emitter). Further, an apertured diaphragm at anode potential is arranged between the electron emitter and the anode and through which the electron beam passes. As electron-emitting material, the electron emitter contains lanthanum hexaboride ($LaB_6$) or an alloy of the systems iridium/cerium (Ir/Ce) or iridium/lanthanum (Ir/La) systems.

6 Claims, 3 Drawing Sheets

X-RAY TUBE WITH A LOW-TEMPERATURE EMITTER

BACKGROUND OF THE INVENTION

1. Field of the Invention

The present invention is directed to an x-ray tube of the type having an anode and an electron emitter from which an electron beam emanates and that is formed—at least in the region of its surface that emits electrons—of an electron-emitting material that has a lower electron affinity than tungsten, and having an apertured diaphragm arranged between the electron emitter and the anode through which the electron beam passes and strikes the incident surface of the anode in a focal spot from which a useful x-ray beam proceeds.

2. Description of the Prior Art

When the electrons of the electron beam strike the anode of an x-ray tube, ions are emitted, in addition to the desired x-radiation, that move in the direction toward the electron emitter along field lines of the electrical field between the electron emitter and the anode. The ions strike the electron emitter with a corresponding kinetic energy. Damage to the electron emitter can thereby occur, for example due to melting, chemical reactions or erosion of the emission layer, possibly reducing the emission capability of the emitter.

Electron emitters of, for example, tungsten that are relatively resistant to ion bombardment are in widespread use in x-ray tubes that are currently widespread. The service life of such electron emitters is limited by their high operating temperature since the electron emitter, and thus the x-ray tube, ultimately fails due to the evaporation of material. When, as in x-ray tubes of the type initially described that are disclosed in German OS 40 26 300 and PCT Application WO 92/03837, an emitter of the type referred to as a low-temperature emitter is employed instead, i.e. emitters that are formed of a material—at least in the region of the electron-emitting surface or area—that has a lower electron affinity than tungsten and that consequently already emits at comparatively low temperatures, the service life of the electron emitter and, thus of the x-ray tube is limited by ion bombardment.

In the x-ray tubes of German OS 40 26 300 and PCT Application 92/03837, moreover, the electron beam passes through an apertured diaphragm that serves as a focussing electrode in PCT Application WO 92/03837 and as a grid or focussing electrode in German OS 40 26 300.

An x-ray tube wherein the electron beam passes through an apertured diaphragm is also disclosed in German OS 42 30 047.

Just like the x-ray tube disclosed in German OS 40 26 301, the x-ray tube of German OS 40 26 300 has a low-temperature emitter wherein lanthanum hexaboride ($LaB_6$) is provided as the electron-emitting material.

SUMMARY OF THE INVENTION

An object of the present invention is to provide an x-ray tube of the type initially described, i.e., an x-ray tube with a low-temperature emitter, wherein the electron emitter, and thus the x-ray tube, has a longer service life.

This object is inventively achieved in an x-ray tube having an anode and an electron emitter from which an electron beam emanates and that is formed—at least in the region of its surface that emits electrons—of an electron-emitting material that has a lower electron affinity than tungsten, and having an apertured diaphragm lying at anode potential arranged between the electron emitter and the anode through which the electron beam passes and strikes the incident surface of the anode in a focal spot from which a useful X-ray beam proceeds.

Since the apertured diaphragm is at anode potential, a field-free space is present in the region of the apertured diaphragm between the incident surface of the anode and the apertured diaphragm. Since the ions produced by the electron bombardment of the anode now arise in the field-free space, only those ions that pass through the apertured diaphragm into the space (which is not field-free) between apertured diaphragm and electron emitter can proceed to the electron emitter. Only a comparatively small portion of the ions produced thus can proceed to the electron emitter, so that an enhanced service life of the electron emitter, and thus of the x-ray tube is achieved.

Since the probability that ions proceed through the apertured diaphragm to the electron emitter decreases the diaphragm aperture becomes smaller, it is advantageous when the electron beam is incident in the focal spot at an angle greater than 45° relative to the surface normal. A diaphragm aperture of minimum size for the cross-section of the electron beam arises, at least when the apertured diaphragm is arranged in a plane that proceeds substantially at a right angle relative to the electron beam. If the electron beam also has a circular cross-section, this results in a minimum size of the through opening of the apertured diaphragm for a given cross-sectional area of the electron beam.

Alloys of iridium-cerium and iridium-lanthanum systems are especially suitable as electron-emitting material for low-temperature emitters. Lanthanum hexaboride is likewise a material that is well-suited for low-temperature emitters.

DESCRIPTION OF THE PREFERRED EMBODIMENTS

Figure 1:
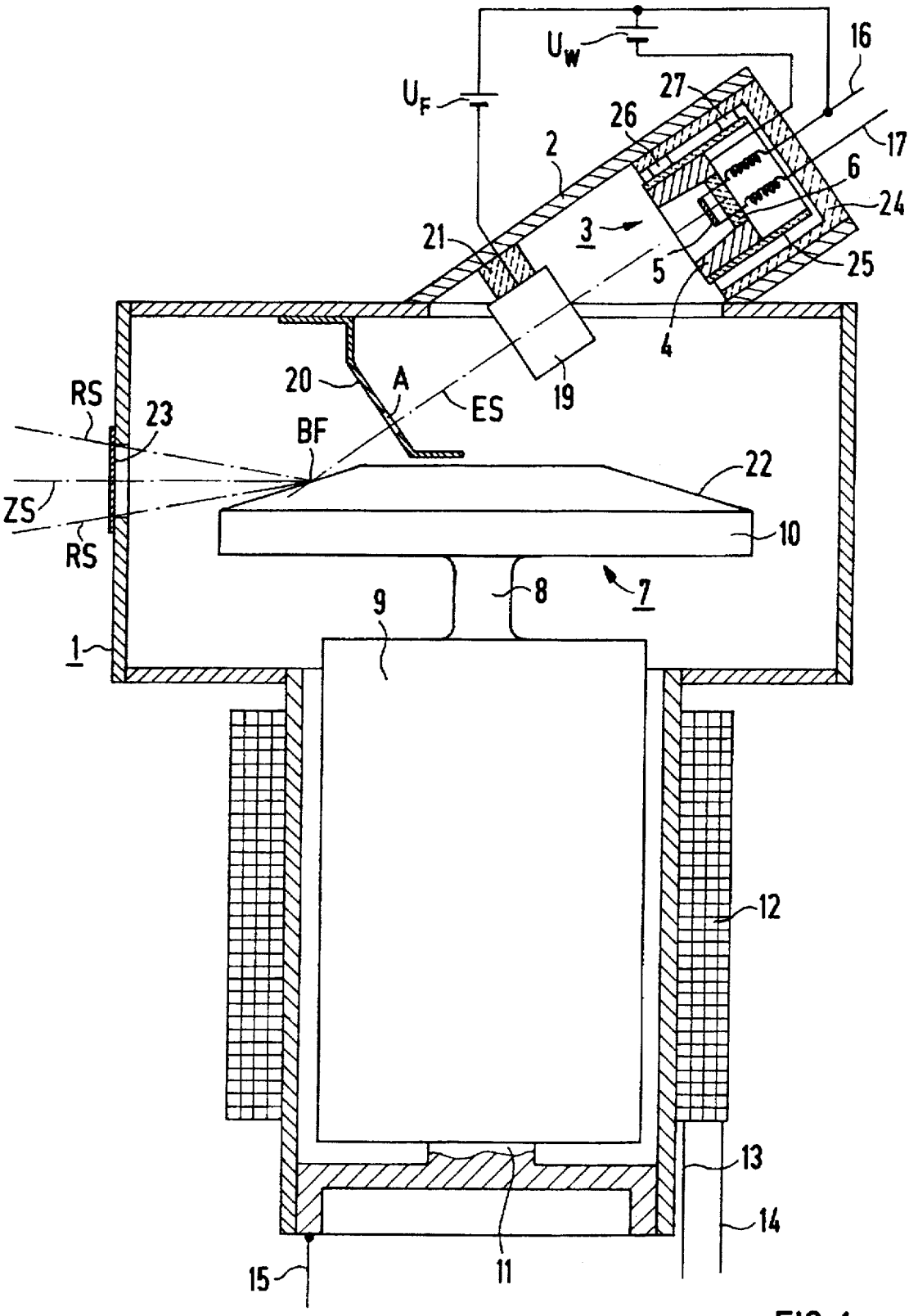
FIG. 1 shows an inventive x-ray tube schematically in longitudinal section.

In FIG. 1, the vacuum housing of the x-ray tube is referenced 1, this being manufactured in a known way in the described exemplary embodiment of metal and ceramic or glass—other materials are possible. A cathode arrangement 3 is attached inside the vacuum housing 1 in a tubular housing projection 2. This cathode arrangement 3 has an electron emitter that is accepted inside a rotationally-symmetric Wehnelt electrode 4. In the exemplary embodiment the electron emitter is a flat emitter in the form of a circular disk-shaped glow cathode 5, and is attached to the Wehnelt electrode 4 with a ceramic disk 6. A rotating anode generally referenced 7 is provided opposite the glow cathode 5 and has an anode dish 10 connected to a rotor 9 via a shaft 8. In a way that is not shown in FIG. 1, the rotor 9 is rotatably seated on an axle 11 connected to the vacuum housing 1. A stator 12, which interacts with the rotor 9 to form an electric motor serving the purpose of driving the rotating anode 7, is placed on the outside wall of the vacuum housing 1 in the region of the rotor 9.

During operation of the X-ray tube, an alternating current is supplied to the stator 12 via lines 13 and 14, so that the anode dish 10 connected to the rotor 9 via the axle 11 rotates.

Figure 2:
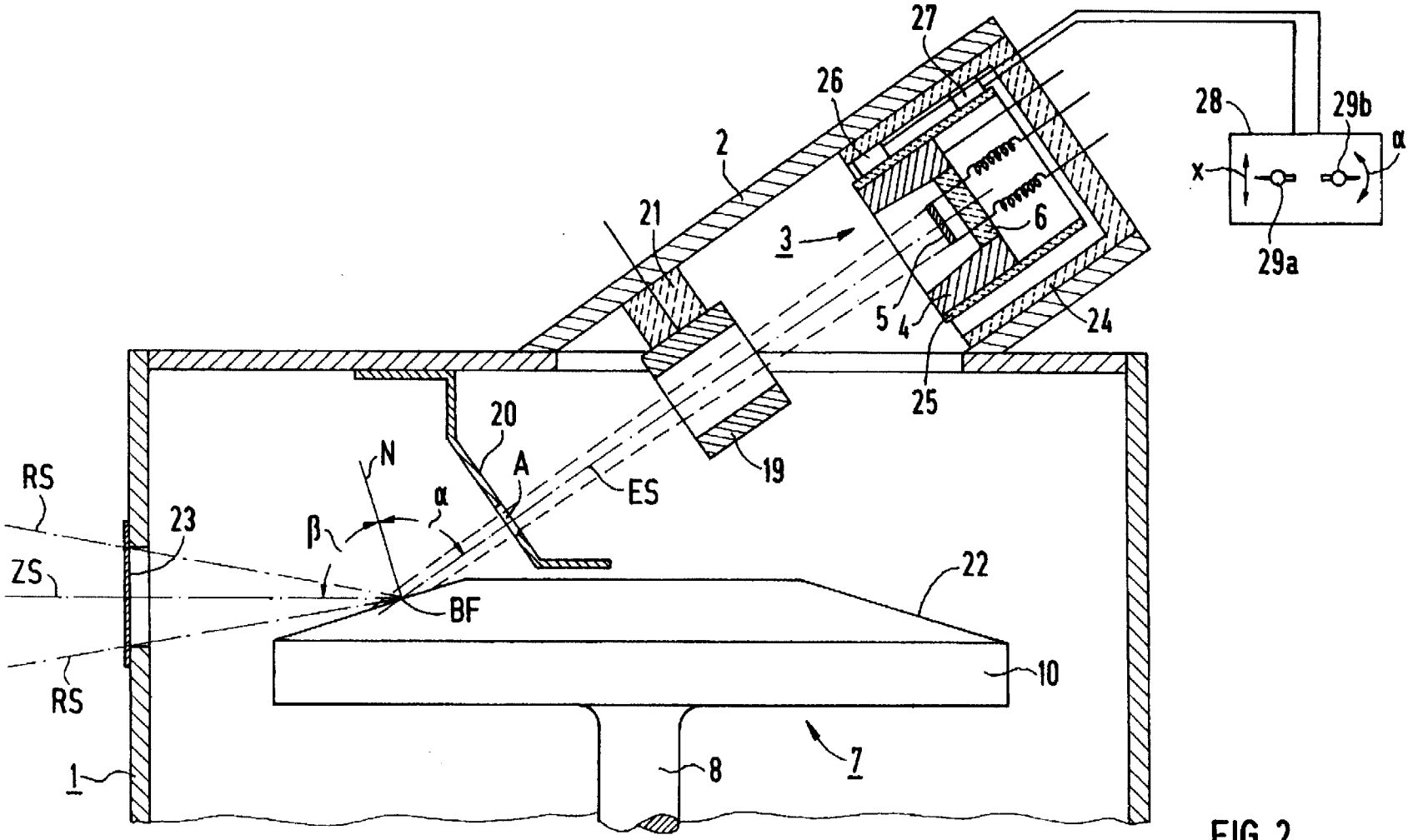
FIG. 2 is an enlarged view of a partial longitudinal section through the x-ray tube of FIG. 1.
Figure 3:
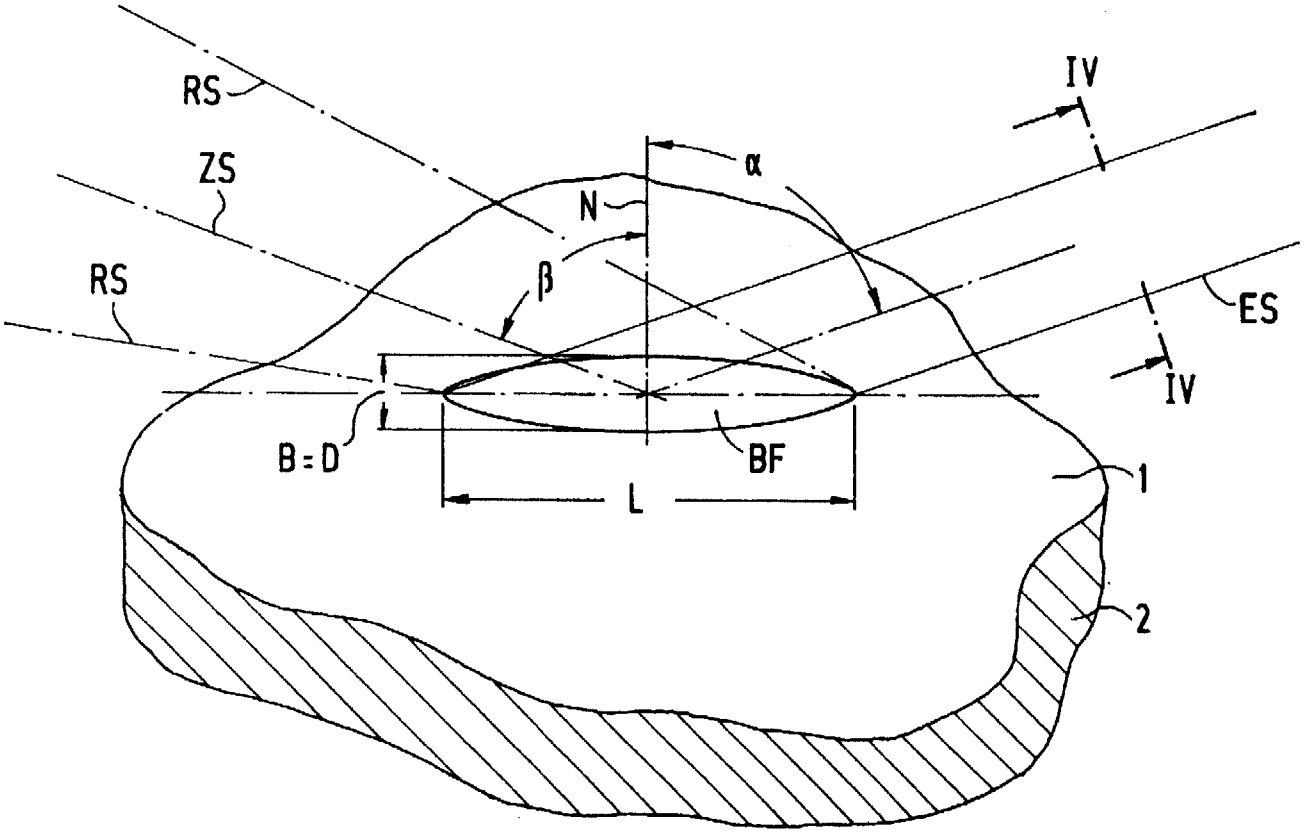
FIG. 3 shows the focal spot of the x-ray tube of FIGS. 1 and 2 in enlarged, perspective view.

The tube voltage is applied via lines 15 and 16. The line 15 is connected to the axle 11, which is in turn electrically conductively connected to the vacuum housing 1. The line 16 is connected to a terminal of the glow cathode 5. The other terminal of the glow cathode 5 is connected to a line 17 via which a filament current can be supplied to the glow cathode 5. When such current is present, an electron beam ES having a circular cross-section emanates from the glow cathode 5. Only the center axis of the electron beam ES is shown in FIG. 1; the edges or limiting propagation path thereof are indicated in FIGS. 2 and 3.

The electron beam ES first passes through a focussing electrode 19, which is attached to the vacuum housing 1 by means of an insulator 21, and then passes through the diaphragm aperture A of an apertured diaphragm 20, which is electrically conductively connected to the vacuum housing 1 and thus lies at anode potential. The diaphragm 20 is arranged in a plane lying substantially at a right angle relative to the electron beam ES. The electron beam ES then, as indicated, strikes an incident surface 22 of the anode dish 10 in a focal spot referenced BF. X-radiation emanates from the focal spot BF. The useful X-ray beam, whose central ray ZS and edge rays RS are indicated with broken lines in FIGS. 1 and 2 emerges through a beam exit window 23.

The glow cathode 5 is a type referred to as a low-temperature emitter composed of a material having low electron affinity compared to tungsten that is usually employed as cathode material, and thus the emitter has a lower operating temperature. The glow cathode 5 is a sintered member of iridium and cerium (Ir-Ce) or iridium and lanthanum (Ir-La) or lanthanum hexaboride ($LAB_6$). Alloys of rhenium, or a metal in the VIII column of the periodic table, (a "column VIII metal") and an element from the group of barium, calcium, lanthanum, yttrium, gadolinium, cerium, thorium, uranium, are generally suitable as materials for low-temperature emitters. Tungsten or molybdenum substrates doped with lanthanum oxide ($La_2O_3$) are also suitable. Further, thoriated tungsten is suitable as material for low-temperature emitters.

As shown in FIG. 1, a Wehnelt voltage $U_W$ is across one terminal of the glow cathode 5 and the Wehnelt electrode 4. As also shown in FIG. 1, a focussing voltage $U_F$ is across one terminal of the glow cathode 5 and the focussing electrode 19.

The respective shapes of the rotationally-symmetric through opening of the focussing electrode 19 provided for the electron beam ES, the focussing voltage $U_F$ and the Wehnelt voltage $U_W$ are selected such that a virtual focus or "cross over" of the electron beam ES occurs that lies behind the incident surface 22, as viewed proceeding from the glow cathode 5. A laminar electron beam ES arises as a result i.e. there are essentially no intersecting electron paths present between the glow cathode 5 and the focal spot BF.

Figure 4:
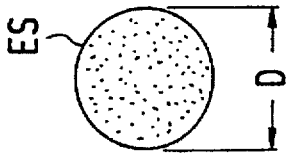
FIG. 4 is a section along the line IV—IV in FIG. 3.

In order to avoid the thermal load of the incident surface from exceeding the allowable limits, the electron beam ES is incident in the focal spot BF at an angle α relative to the surface normal N of the incident surface 22 such that a line-shaped focal spot, more precisely a thin, elliptical focal spot BF, arises (see FIG. 3). The width B of the focal spot BF corresponds to the diameter D of the electron beam (see FIG. 4) that, with a given geometry of the glow cathode 5, the Wehnelt electrode 4, the focussing electrode 19 and the apertured diaphragm 20, as well as with a given filament current and a given tube voltage, is dependent on the Wehnelt voltage $U_W$ and on the focussing voltage $U_F$.

In view of focal spot dimensions that are usually desired, the angle α is selected to produce a length L of the focal spot between 1 through 15 mm, given a diameter D of the electron beam ES of 0.1 through 2.0 mm. The indicated range of diameter is valid for the diameter of the electron beam ES following the apertured diaphragm 20.

The position of the beam exit window 23 is selected such that the angle B of the central ray ZS of the useful X-ray beam relative to the surface normal N of the incident surface 22 is substantially equal to the angle α in the focal spot BF. As viewed in the direction of the central ray ZS of the useful X-ray beam, a substantially circular focus, beneficial for a high imaging quality, arises.

As a result of the circular cross-section of the electron beam ES, the pre-condition is initially established that for a Gaussian curve-like intensity distribution of the X-radiation in the focal spot for arbitrary directions. Since the electron beam ES passes through the apertured diaphragm 20 that is at anode potential and is arranged between the glow cathode 5 and the anode dish 10, it is assured that the electron beam ES still has its circular cross-section in the immediate proximity of the anode dish 10 as well. As a result of the apertured diaphragm 20 being at anode potential, a field-free space in which no field-conditioned distortions of the cross-sectional geometry of the electron beam ES can occur, is located between the apertured diaphragm and the anode dish 10. This assures that an electron beam ES having a circular cross-section in fact strikes the incident surface 22. An intensity distribution of the X-radiation that is closely approximated to the Gaussian curve ideal is thus assured in the focal spot, namely as viewed in arbitrary directions. Despite employing a cathode arrangement 3 that generates an electron beam ES having a circular cross-section, such an intensity distribution would not be assured in the absence of the apertured diaphragm 20 since the electron beam ES incident on the incident surface 22 of the anode would clearly deviate from a circular cross-section with respect to its cross-sectional geometry.

Since the electron beam ES has a laminar beam profile, an additionally improved approximation to the Gaussian curve ideal of the intensity distribution of the X-radiation is achieved in the focal spot BF.

The apertured diaphragm 20 also protects the glow cathode 5 from ion bombardment. Since the ions produced in the inventive X-ray tube by bombarding the anode dish 10 with the electron beam ES arise in the field-free space, only those that pass through the apertured diaphragm 20 into the space (which is not field-free) between apertured diaphragm 20 and glow cathode 5 can proceed to the glow cathode 5. Only a comparatively small portion of the produced ions thus proceed to the glow cathode 5, so that an enhanced service life of the glow cathode 5, and thus of the x-ray tube, is achieved with the inventive x-ray tube compared to an x-ray tube without an apertured diaphragm. The advantage of the low-temperature emitter employed compared to a conventional electron emitter, for example of tungsten, of achieving a longer service life as a result of the lower operating temperature, can thus take full effect, since a premature failure of the glow cathode 5 due to ion bombardment is avoided.

Since the electron beam ES strikes the focal spot BF at an angle α relative to the surface normal N of the incident surface 22 that is greater than 45°, and since the apertured diaphragm 20 is arranged in a plane that proceeds essentially at a right angle relative to the electron beam ES, the diaphragm aperture A of the apertured diaphragm 20 has a size that is smaller than would be the case if an electron beam for generating a focal spot of the same dimensions were incident in the focal spot BF at an acute angle relative to the surface normal N of the incident surface 22. This is advantageous since the probability that ions proceed to the glow cathode 5 decreases as the diaphragm aperture A becomes smaller. Since the electron beam ES also has a circular cross-section, a minimum size of the diaphragm aperture A of the apertured diaphragm 20 is achieved for a given cross-sectional area of the electron beam ES and a given angle α.

Two piezoelectric translators 26 and 27, which are piezocrystals, are provided between the inside of the wall section of a ceramic part 24 that closes the housing projection 2 and a ceramic tube 25 that accepts the Wehnelt electrode 4 with the glow cathode 2. The piezoelectric translators 26 and 27 serve, first, for the mechanical connection of the cathode arrangement 3 to the housing projection 2. Second, for adjustment purposes, they serve the purpose of adjusting the glow cathode 5 and the rotating anode 7 relative to one another for changing the angle α of the electron beam ES relative to the surface normal N of the incident surface 22, and thereby displacing the focal spot BF on the incident surface 22. This is achieved in a simple way by adjusting the glow cathode 5 and the rotating anode 7 relative to one another in a plane that contains the electron beam ES and the surface normal N. To this end, the piezoelectrical translators 26 and 27 are built change length essentially in the direction of the surface normal N, given variation of the voltages across to them.

As shown in FIG. 2, the piezoelectric translators 26 and 27 are connected to an operating unit 28. Dependent on whether a rotary knob **29*a* adjustable in a range x, or a rotary knob 29*b*, adjustable in a range α, is actuated, the piezoelectric translators 26 and 27** are driven in the same or in opposite directions. In the case of isodirectional drive, a parallel displacement of the electron beam ES in the direction of the surface normal N in one or the other direction occurs dependent on the sense of the drive. Given drive in opposite directions, a modification of the angle α of the electron beam ES relative to the surface normal N occurs in the one or other direction.

The piezoelectric translators 26 and 27 thus form an adjustment unit that makes it possible—within the adjustment limits of the piezoelectric translators 26 and 27—to adjust the alignment of the cathode arrangement 3 and the rotating anode 7 relative to one another such that the focal spot BF assumes the position desired.

This adjustment possibility is especially significant when the angle between the surface normal N and the electron beam ES is very large, for example 80°, since slight misadjustments can then result in the electron beam ES missing the incident surface 22 as a consequence of thermally caused, axial dislocations of the rotating anode 7 which occur during operation of the x-ray tube, and as a consequence of thermally caused tiltings and/or dislocations of the cathode arrangement 3 that contains the glow cathode 5.

Since the piezoelectric translators 26 and 27 can also be actuated with the operating unit 28 even when the x-ray tube has already been evacuated, it is always possible to intervene in a corrective fashion with an appropriate actuation of the piezoelectric translators 26 and 27, both in the case of thermally caused, axial dislocations of the rotating anode 7 and in the case of thermally caused tiltings and/or dislocations of the cathode arrangement 3 that contains the glow cathode 5. The assembly of the X-ray tube thus becomes simple since no special adjustments are required in order to assure a proper incidence of the electron beam on the incident surface 22 of the rotating anode 7.

In the described exemplary embodiment, piezoelectric translators 26 and 27 are provided in view of their low cost. Other electrical, mechanical or electro-mechanical adjustment elements alternatively can be used.

In the described exemplary embodiment, the adjustment unit formed by the piezoelectric translators 26 and 27 is allocated to the cathode because of the lower mass or lower weight thereof, i.e., only the cathode arrangement 3 is adjusted for achieving the desired relative motion between cathode arrangement 3 and rotating anode 7. It is also possible, however, to allocate the adjustment unit to the rotating anode 7 and thus to effect the desired relative motion by adjusting only the rotating anode 7. Further, it is also possible to allocate an adjustment unit both to the cathode arrangement 3 and to the rotating anode 7 and to effect the desired relative motion by adjusting both the cathode arrangement and the rotating anode 7. In the described exemplary embodiment, the adjustment unit contains a plurality of adjustment elements, namely the two piezoelectric translators 26 and 27. It can be sufficient under certain circumstances, however, for the adjustment unit contain only one adjustment element.

Alternatively to the described fashioning of the glow cathode 5 as a sintered member, there is also the possibility of constructing the glow cathode 5 of a base member with a coating applied on the base member in the region of the surface area provided for electron emission. The coating is composed of a material that has a low electron affinity compared to the material of the base member. For example, tungsten or molybdenum comes are suitable as material for the base member and lanthanum hexaboride ($LaB_6$) is suitable as material for the coating.

There is also the possibility of constructing the glow cathode 5 of a base member and a coating that covers the base member except in the region of its surface area provided for electron emission and that is composed of a material that comprise a high electron affinity compared to the material of the base member. For example, $LaB_6$ is suitable as material for the base member and tungsten or molybdenum is suitable as material for the coating.

If an electron emitter that is insensitive to ion bombardment is provided, some other electrode at anode potential can be provided instead of the apertured diaphragm 20, assuring that the electron beam ES in fact strikes the incident surface 22 with a circular cross-section.

Although the above-described exemplary embodiment is a rotating anode x-ray tube., the invention can also be employed in X-ray tubes having a fixed anode.

In the described exemplary embodiment, the electron emitter is formed by a directly heated glow cathode. Instead of a directly heated glow cathode, however, some other electron emitter, for example an indirectly heated cathode or an electron beam gun, for example a Pierce gun, can be employed. If a directly heated glow cathode is employed as the electron emitter, this need not necessarily be fashioned as a flat emitter, as in the case of the exemplary embodiment. An electron emitter that, in particular, is concavely curved can be utilized.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

an anode at an anode potential, said anode having an incident surface with a surface normal;

an electron emitter which emits an electron beam which strikes said incident surface of said anode in a focal spot, thereby producing an x-ray beam emanating from said focal spot and ions, said x-ray beam having a central ray, said electron emitter having an electron-emitting surface and said electron emitter comprising, at least in a region of said electron-emitting surface, electron-emitting material having a lower electron affinity than tungsten;

said electron emitter being disposed in a region subject to permeation by said ions:

means for protecting said region of said electron-emitting surface from being struck by said ions consisting of a diaphragm at anode potential disposed between said electron emitter and said anode having an aperture through which said electron beam passes, said diaphragm being disposed perpendicularly relative to said electron beam; and said electron emitter being disposed relative to said anode so that said electron beam is incident on said focal spot at a first angle relative to said surface normal which is greater than 45°, and so that said central ray of said x-ray beam is disposed at a second angle relative to said surface normal which is substantially equal to said first angle.

2. An x-ray tube as claimed in claim 1 wherein said electron-emitting material comprises material selected from the group consisting of lanthanum oxide-doped tungsten, lanthanum oxide-doped molybdenum, and thoriated tungsten.

3. An x-ray tube as claimed in claim 1 wherein said electron emitter comprises an electron emitter which emits an electron beam having a substantially circular cross-section.

4. An x-ray tube as claimed in claim 1 wherein said electron-emitting material comprises an alloy of first and second elements, wherein said first element is selected from the group consisting of rhenium and a column VIII metal, and wherein said second element is selected from the group consisting of barium, calcium, lanthanum, yttrium, gadolinium, cerium, thorium and uranium.

5. An x-ray tube as claimed in claim 4 wherein said electron-emitting material comprises lanthanum hexaboride.

6. An x-ray tube as claimed in claim 4 wherein said electron-emitting material comprises an alloy system selected from the group consisting of iridium/cerium, iridium/lanthanum and iridium/platinum alloy systems.

* * * * *